US012082690B2

(12) United States Patent
Jiang

(10) Patent No.: US 12,082,690 B2
(45) Date of Patent: Sep. 10, 2024

(54) FOLDABLE PICNIC TABLE

(71) Applicant: Yixiang Blow Molding Furniture (Ningbo) Co., Ltd., Yuyao (CN)

(72) Inventor: Jinglei Jiang, Yuyao (CN)

(73) Assignee: Vixiang Blow Molding Furniture (Ningbo) Co., Ltd., Yuyao (CN)

( * ) Notice: Subject to any disclaimer, the term of this patent is extended or adjusted under 35 U.S.C. 154(b) by 127 days.

(21) Appl. No.: 18/046,729

(22) Filed: Oct. 14, 2022

(65) Prior Publication Data

US 2024/0023704 A1 Jan. 25, 2024

(30) Foreign Application Priority Data

Jul. 25, 2022 (CN) ..... 202222000496.5

(51) Int. Cl.
*A47B 3/14* (2006.01)

(52) U.S. Cl.
CPC ..... *A47B 3/14* (2013.01)

(58) Field of Classification Search
CPC ..... A47B 3/14; A47B 2200/11; A47C 11/00; A47C 4/00
See application file for complete search history.

(56) References Cited

U.S. PATENT DOCUMENTS 3,276,815 A * 10/1966 Cardy ..... A47C 9/06 297/158.4
3,574,393 A * 4/1971 Hughes ..... A47B 3/14 108/35
6,347,831 B1 * 2/2002 Nye ..... A47B 3/14 297/118
11,918,105 B2 * 3/2024 Choi ..... A47B 3/14
2004/0227382 A1 * 11/2004 Lin ..... A47B 83/02 297/158.4
2021/0177135 A1 * 6/2021 Leng ..... A47B 39/06
2021/0274929 A1 * 9/2021 Choi ..... A47B 3/14

* cited by examiner

*Primary Examiner* — Milton Nelson, Jr.
(74) *Attorney, Agent, or Firm* — Wang Law Firm, Inc.

(57) ABSTRACT

A foldable picnic table with sitting benches is a table having a table plate and a number of table supports, and a plurality of benches having a bench body and a plurality of bench supports; wherein, each table support has an upper support and a lower support; the bottoms of each lower support and adjacent bench support are connected through a connecting piece; the table plate is capable of being lowered to the same height as the bench bodies when the upper supports and the lower supports are retracted relative to each other, the lower supports and the bench supports are folded to each other and turn over the bench bodies to the back of the table plate. Therefore, it is very convenient to fold, the size after folding is very small, and it saves transportation costs.

8 Claims, 12 Drawing Sheets

FOLDABLE PICNIC TABLE

TECHNICAL FIELD OF THE INVENTION

The present invention relates to outdoor furniture, and in particular to a foldable picnic table with sitting benches.

BACKGROUND OF THE INVENTION

With the continuous improvement of living standards, people take more and more time for outdoor leisure activities, such as having a picnic in parks, beaches or other places. If there are picnic tables that can be carried conveniently, the comfort of the picnic will be greatly improved. Various different picnic tables have been disclosed in the prior art. For example, a Chinese Patent CN 212574462 U (patent No.: 202020261462.X) disclosed a foldable picnic table, comprising a table support and a bench support, wherein a plurality of support legs are disposed between the table support and the bench support; a plurality of support rods are disposed between the table support and the support legs; the bench support has a first connecting piece, and the table support has a second connecting piece; the support legs are hinged to the first connecting piece and the second connecting piece; the bench support has a expansion rod; the expansion rod comprises a fixed tube and a moving tube; and, the first connecting piece is disposed on the moving tube. Although the picnic table can realize the folding function, it is inconvenient to fold and the folded size has room for further improvement.

SUMMARY OF THE INVENTION

It is an object of the present invention to provide a foldable picnic table with sitting benches that is convenient to fold and small in folded size.

For achieving the above object, the foldable picnic table with sitting benches comprises a table and a plurality of benches attached to the table; the table comprises a table plate having a left side, a right side, a front side and a rear side, and a plurality of table supports rotatably connected to the left and right sides of the table plate; each bench comprises a bench body having a left side and a right side, and a plurality of bench supports rotatably connected to the left and right sides of the bench bodies; a plurality of connecting pieces, each connecting piece connects to one bench support to one table support; wherein, each table support has an upper support and a lower support capable of extending out of or retracting into the upper support; the bottom of each lower support is connected to the bottom of adjacent bench support through a connecting piece; the table plate is capable of being lowered to the same height as the bench bodies when the upper supports and the lower supports are retracted relative to each other, and in this state, the lower supports and the bench supports are folded to each other through the plurality of connecting pieces so as to turn over the plurality of bench bodies to the back of the table plate.

Preferably, two benches are respectively disposed at the front and rear sides of the table plate.

To reduce the size after folded, preferably, when the lower supports and the bench supports are folded toward to each other, two bench bodies of the two benches are folded over to the back of the table plate and located side by side, and the edges of the bench bodies do not extend beyond the edges of the table plate.

To enable the table supports and the bench supports to be folded to each other, preferably, each upper support comprises a upper vertical tube, each lower support comprises a lower vertical tube and a lower transverse tube connected to the bottom of the lower vertical tube; the upper vertical tubes and the lower vertical tubes are telescopic with each other and is capable of moving up and down relative to each other; each bench support has L-shape and has an upper rod and a horizontal rod, and each lower transverse tube is rotatably connected to the corresponding horizontal rod through the connecting pieces.

To enable the table plate to be fixed after being lifted up, preferably, a locking mechanism for locking the upper vertical tubes and the lower support in an extended state is disposed between one upper vertical tube and the corresponding lower vertical tube.

To further reduce the size after folded, preferably, a plurality of table plate recesses for receiving the lower transverse tubes are formed on the bottom surface of the table plate, and a plurality of bench plate recesses for receiving the horizontal rods are formed on the bottom surface of each bench body.

Preferably, each connecting piece comprises a first joint and a second joint both rotatable relative with each other; the first joint has a first connecting column and a first rotating portion, the second joint has a second connecting column and a second rotating portion; the first connecting column is inserted into the corresponding horizontal rod, the second connecting column is inserted into the corresponding lower transverse tube; the first rotating portion is located below the second rotating portion, and a rotating shaft passes through the first rotating portion and the second rotating portion, the first rotating portion and the second rotating portion are capable of rotating around the rotating shaft.

Preferably, the first connecting column has a protrusion, and the second connecting column has a corresponding slot for receiving the protrusion when the first joint and the second joint are unfolded completely.

Preferably, each connecting piece comprises a first connector and a second connector both rotatable relative with each other; the first connector has a U-shaped first connecting sheet and a first lug connected to the first connecting sheet; the second connector has a U-shaped second connecting sheet and a second lug connected to the second connecting sheet; the first connecting sheet is semi-wrapped on the corresponding horizontal rod, the second connecting sheet is semi-wrapped on the corresponding lower transverse tube, a spindle passes through the first lug and the second lug, the first lug and the second lug are capable of rotating around the spindle.

To prevent the bench plates from falling when the table is lifted after folded, preferably, each table support has a lock catch; and when the bench bodies and the table plate are folded to each other, each bench support is relatively fixed with the corresponding table support through the lock catch.

Compared with the prior art, the present invention has the following advantages. The bottoms of the lower supports of the table supports of the foldable picnic table are connected to the bottoms of the bench supports through the connecting pieces, the table plate can be lowered to the same height as the bench bodies in the state where the upper supports and the lower supports are retracted relative to each other, and the lower supports and the bench supports are folded to each other through the connecting pieces to turn over the bench bodies to the back of the table plate. Therefore, it is very convenient to fold, the size after folded is very small, and it is advantageous to save the transportation cost.

DETAILED DESCRIPTION OF THE INVENTION

Figure 1:
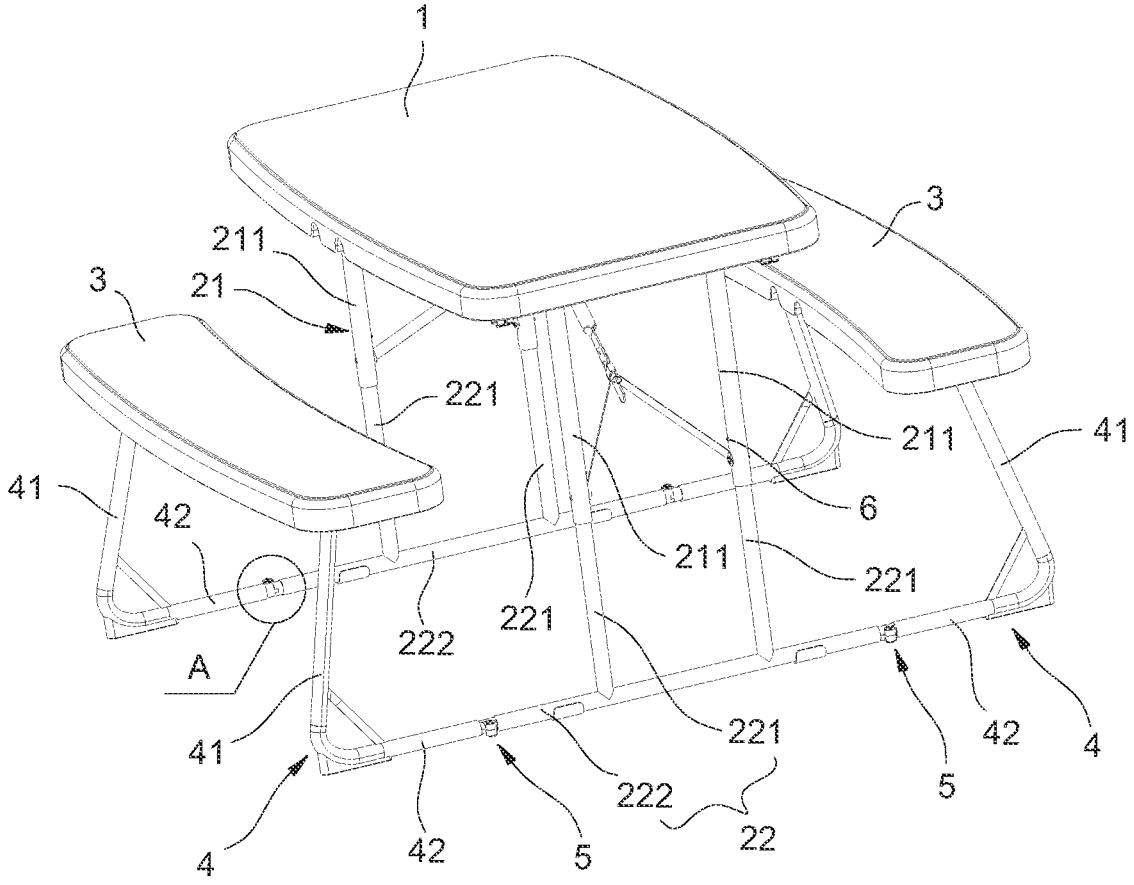
FIG. 1 is a perspective view of a foldable picnic table according to Embodiment 1 of the present invention.
Figure 2:
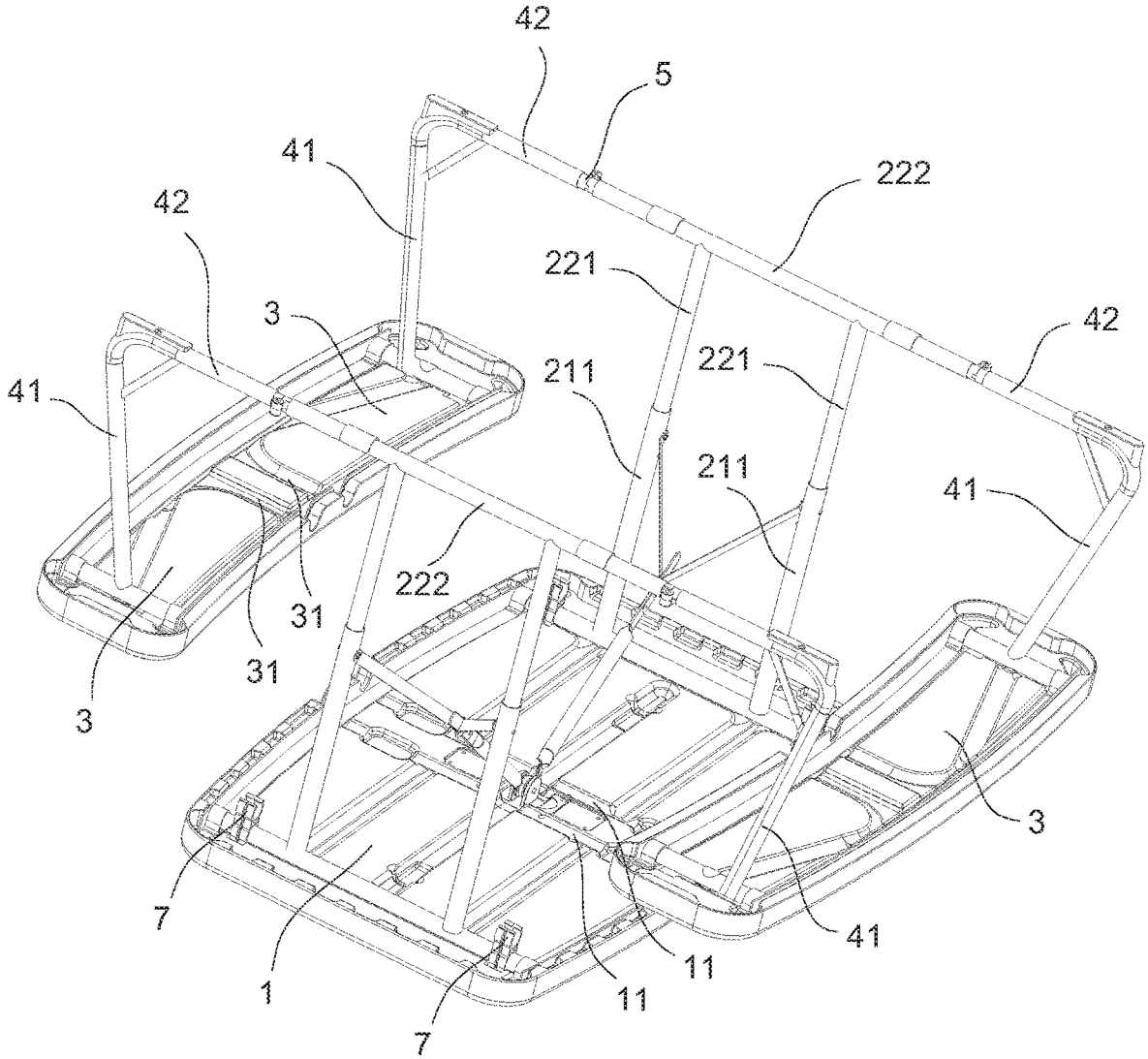
FIG. 2 is another perspective view of the picnic table shown in FIG. 1 when viewed from bottom.
Figure 3:
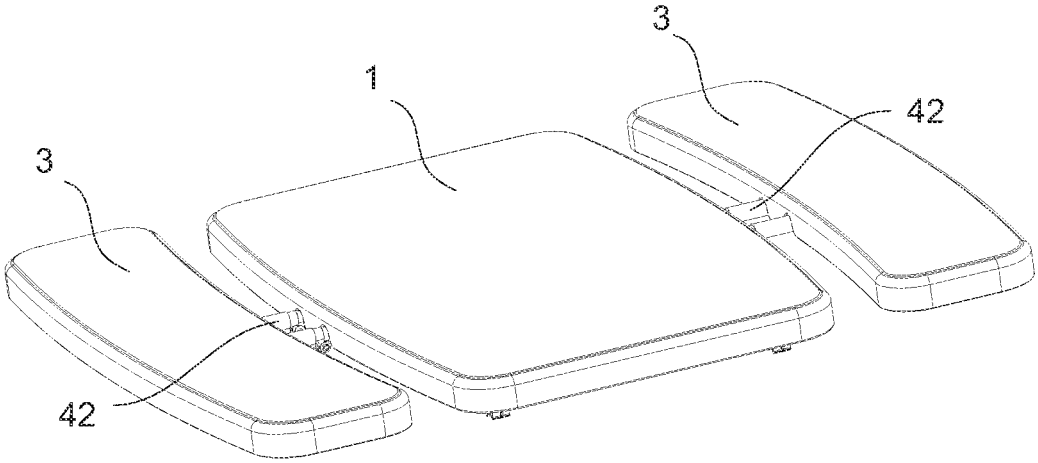
FIG. 3 is a perspective view of the picnic table after the table plate and the bench bodies shown in FIG. 1 are folded to form a plane.
Figure 4:
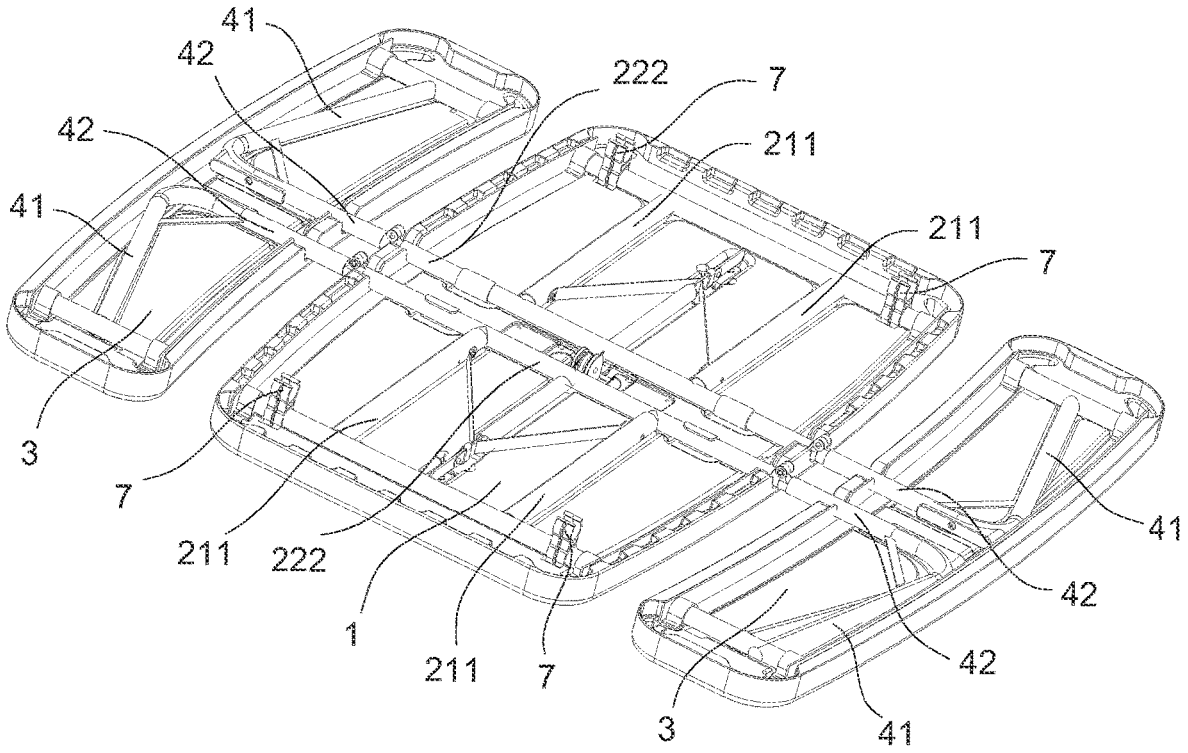
FIG. 4 is another perspective view of FIG. 3 when viewed from bottom.

The present invention will be further described in detail below by embodiments with reference to the accompanying drawings.

Embodiment 1

As shown in FIGS. 1-6, the foldable picnic table with sitting benches in Embodiment 1 comprises a table and a plurality of benches attached to the table. There are two benches respectively disposed on two sides of the table. The table comprises a table plate 1 having a left side, a right side, a front side and a rear side, and a plurality of table supports 2 rotatably connected to the left and right sides of the table plate 1; each bench comprises a bench body 3 having a left side and a right side, and a plurality of bench supports 4 rotatably connected to the left and right sides of the bench bodies 3. The table supports 2 are rotatably connected to the table plate 1, so that the table supports 2 can be turned over to the back of the table plate 1. The bench supports 4 are rotatably connected to the bench bodies 3, so that the bench supports 4 can be turned over to the back of the bench bodies 3. The specific folding structure and folding principle of the table supports 2 and the bench supports 4 are of conventional designs and will not be described here.

In this embodiment, each table support 2 has an upper support 21 and a lower support 22 capable of extending out of or retracting into the upper support 21. The table plate 1 is capable of being lowered to the same height as the bench bodies 3 when the upper supports 21 and the lower supports 22 are retracted relative to each other. Each upper support 21 comprises a upper vertical tube 211, each lower support 22 comprises a lower vertical tube 221 and a lower transverse tube 222 connected to the bottom of the lower vertical tube 221; the upper vertical tubes 211 and the lower vertical tubes 221 are telescopic with each other and is capable of moving up and down relative to each other. A locking mechanism 6 is disposed between one upper vertical tube 211 and the corresponding lower vertical tube 221. When the table plate 1 is lifted up, that is, when the upper vertical tubes 211 are lifted up relative to the lower vertical tubes 221, the positions of the upper vertical tubes 211 can be locked by the locking mechanism 6, so that the upper vertical tubes 211 are kept in the lifted-up state. The locking mechanism 6 may adopt the locking mechanism on the existing extension tubes, and the specific structure will not be described here.

In this embodiment, each bench support 4 has L-shape and has an upper rod 41 and a horizontal rod 42. In this embodiment, the horizontal rods 42 are also of a tubular structure. Each lower transverse tube 222 is rotatably connected to the corresponding horizontal rod 42 through the connecting pieces 5.

When the picnic table needs to be folded, the locking mechanism 6 is released first, so that the upper vertical tubes 211 move down relative to the lower vertical tubes 221, that is, the upper supports 21 and the lower supports 22 of the table supports 2 are retracted relative to each other. At this time, the table plate 1 is lowered to the same height as the bench bodies 3. Then, the table supports 2 are turned over to the back of the table plate 1, and the bench supports 4 are turned over to the back of the bench bodies 3. In this embodiment, a plurality of table plate recesses 11 for receiving the lower transverse tubes 222 are formed on the bottom surface of the table plate 1, and a plurality of bench plate recesses 31 for receiving the horizontal rods 42 are formed on the bottom surface of each bench body 3, so that it is advantageous to reduce the thickness of the picnic table after the table supports 2 and the bench supports 4 are folded, and it is advantageous to reduce to the packaged size, with reference to FIGS. 3 and 4. Finally, the lower transverse tubes 222 of the lower supports 22 and the horizontal rods 42 of the bench supports 4 are folded to each other through connecting pieces to turn over the bench bodies 3 to the back of the table plate 1, so that the whole folding process is completed, with reference to FIGS. 5 and 6. The unfolding process of the picnic table is opposite to the folding process and will not be described here.

Figure 5:
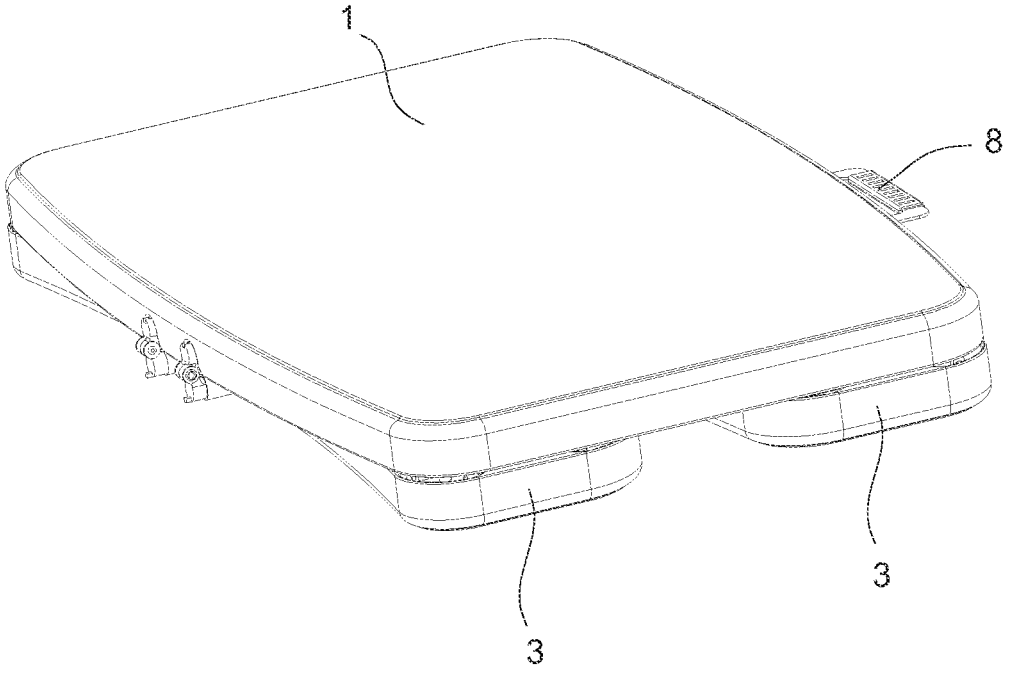
FIG. 5 is a perspective view of the picnic table after the picnic table shown in FIG. 1 is folded completely.
Figure 6:
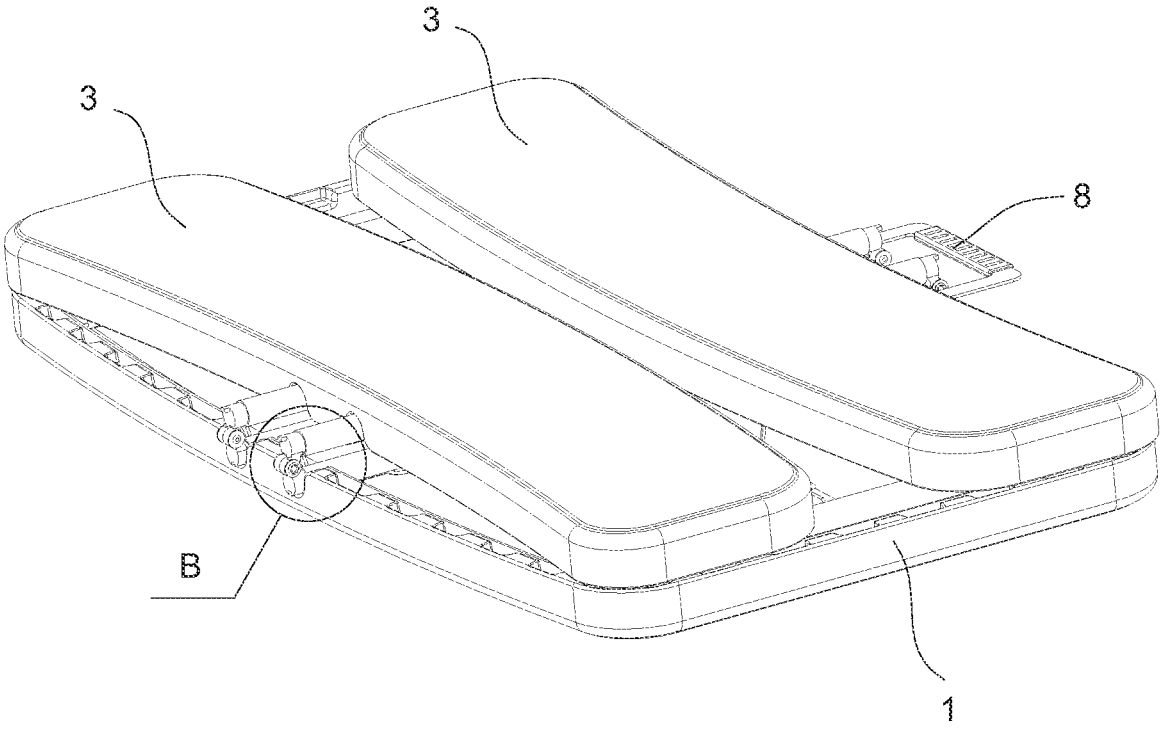
FIG. 6 is another perspective view of the picnic table of FIG. 5 when viewed from bottom.
Figure 7:
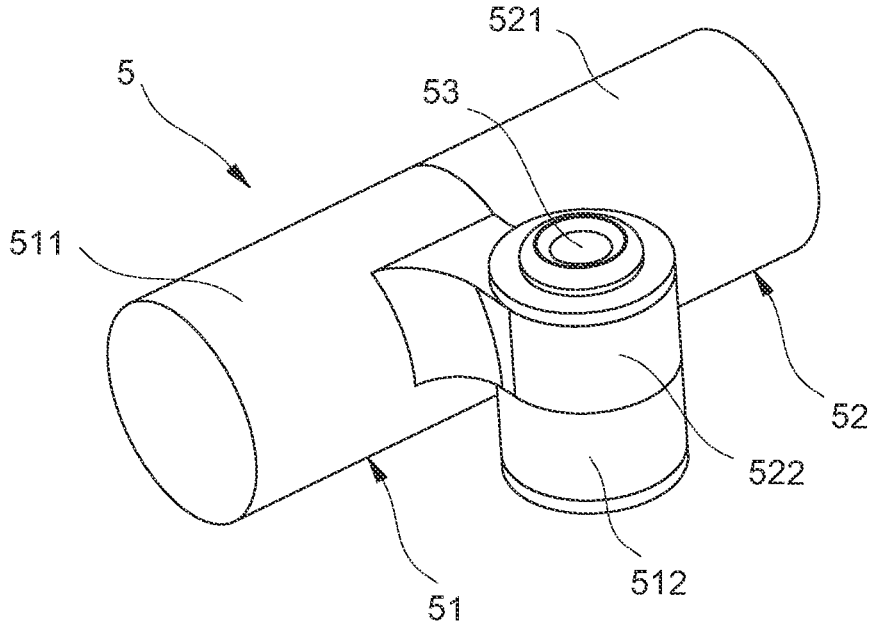
FIG. 7 is a perspective view of a connecting piece according to Embodiment 1 of the present invention.
Figure 8:
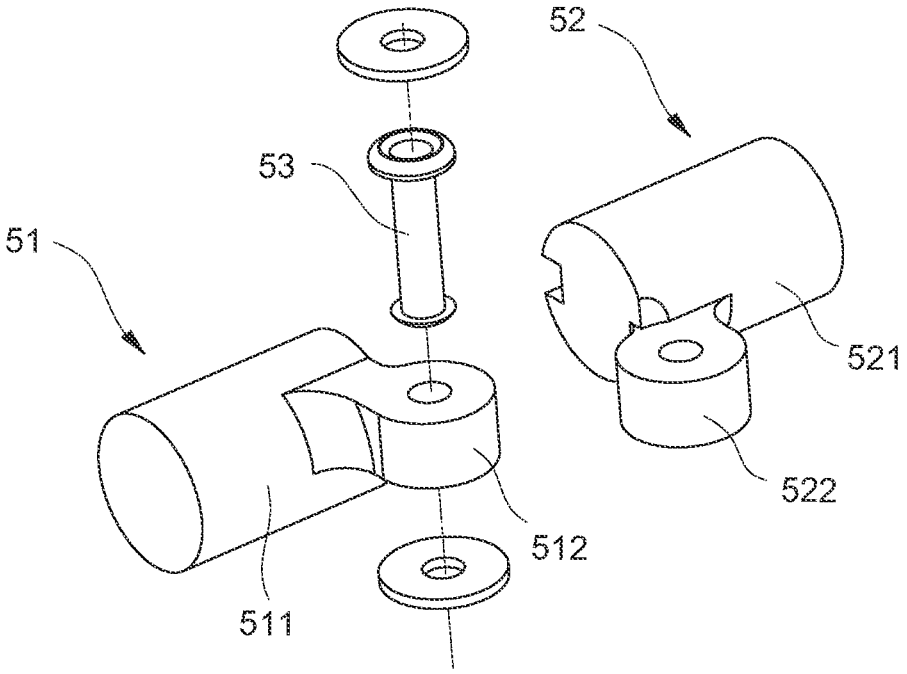
FIG. 8 is an exploded view of the connecting piece shown in FIG. 7.
Figure 9:
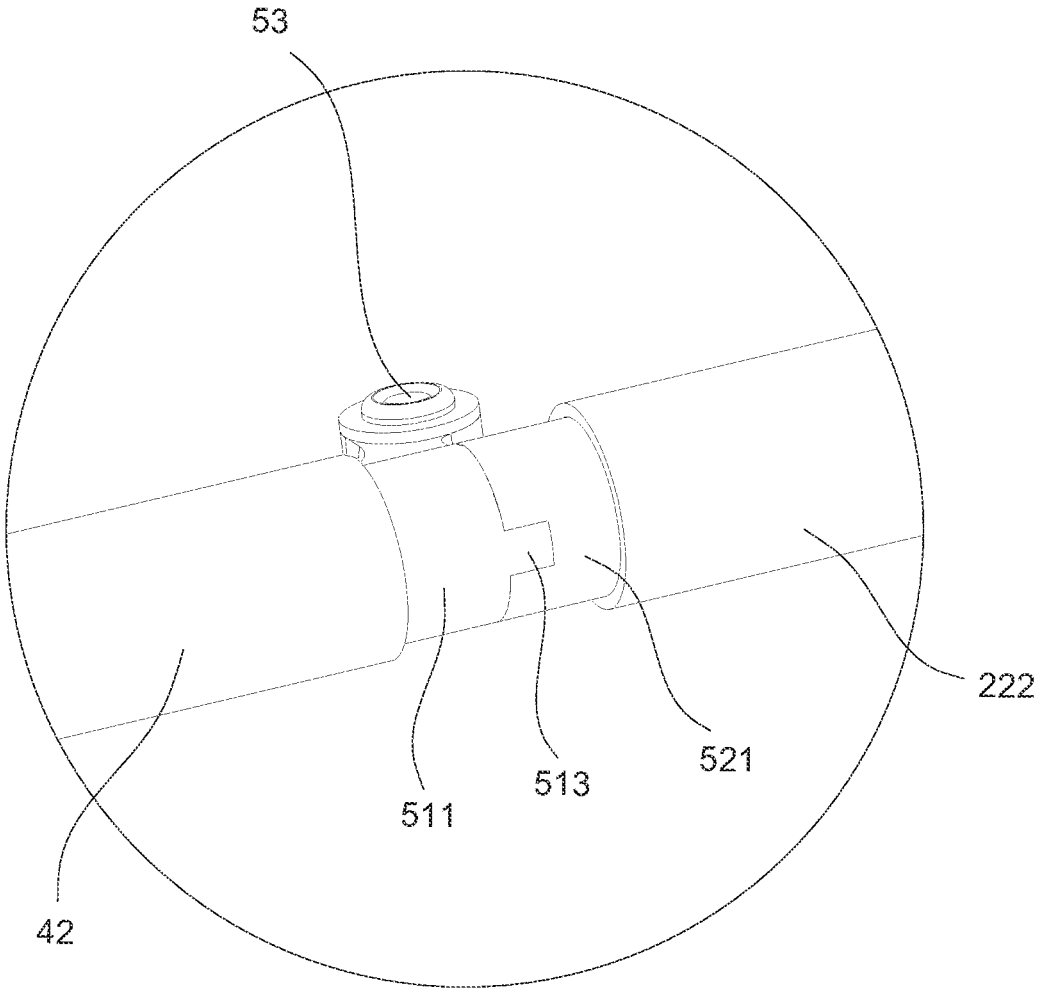
FIG. 9 is an enlarged view of part-A in FIG. 1.
Figure 10:
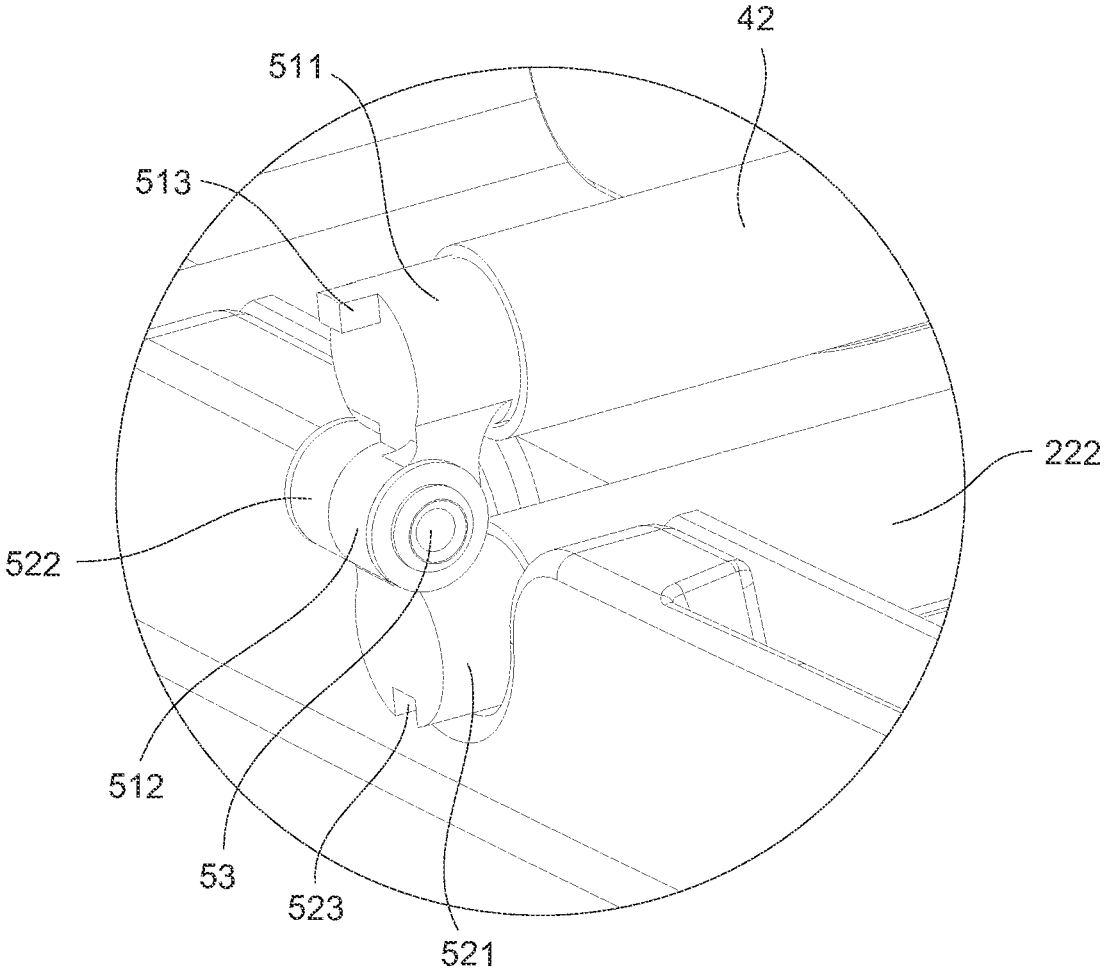
FIG. 10 is an enlarged view of part-B in FIG. 6.

In this embodiment, when the lower supports 22 and the bench supports 4 are folded toward to each other, two bench bodies 3 of the two benches are folded over to the back of the table plate 1 and located side by side, and the edges of the bench bodies 3 do not extend beyond the edges of the table plate 1, so that it is advantageous to reduce the packaged size. Each table support 2 has a lock catch 7 disposed on the upper support 21; and when the bench bodies 3 and the table plate 1 are folded to each other, the upper rod 41 of each bench support 4 is relatively fixed with the corresponding upper support 21 through the lock catch 7, thereby preventing the bench bodies 3 from falling when the table is lifted up. In addition, as shown in FIGS. 5 and 6, a handle 8 may be mounted on the side of the table plate 1. In the folded state, a user can hold the handle 8 to move the table.

As shown in FIGS. 7-10, each connecting piece 5 in this embodiment comprises a first joint 51 and a second joint 52 both rotatable relative with each other; the first joint 51 has a first connecting column 511 and a first rotating portion 512, the second joint 52 has a second connecting column 521 and a second rotating portion 522; the first connecting column 511 is inserted into the corresponding horizontal rod 42, the second connecting column 521 is inserted into the corresponding lower transverse tube 222; the first rotating portion 512 is located below the second rotating portion 522, and a rotating shaft 53 passes through the first rotating portion 512 and the second rotating portion 522, the first rotating portion 512 and the second rotating portion 522 are capable of rotating around the rotating shaft 53. Also, the first connecting column 511 has a protrusion 513, and the second connecting column 521 has a corresponding slot 523 for receiving the protrusion 513. When the lower transverse tubes 222 of the table supports 2 and the horizontal rods 42 of the bench supports 4 are folded relative to each other, that is, in the folding process from the state shown in FIGS. 3 and 4 to the state shown in FIGS. 5 and 6, the first rotating portions 512 of the first joints 51 and the second rotating portions 522 of the second joints 52 are rotated about the rotating shafts 53 relative to each other, and the first connecting columns 511 and the second connecting columns 521 are rotated synchronously until the first connecting columns 511 and the second connecting columns 512 are turned over to the folded state, so that the folding process is completed. When the picnic table is in the unfolded state as shown in FIG. 1, the lower transverse tubes 222 of the table supports 2 and the horizontal rods 42 of the bench support 4 are unfolded to the same straight line. At this time, when the first joints 51 and the second joints 52 are unfolded completely, the protrusion s 513 are clamped into the corresponding slots 523 to realize the limiting function, with reference to FIG. 9.

Embodiment 2

Figure 11:
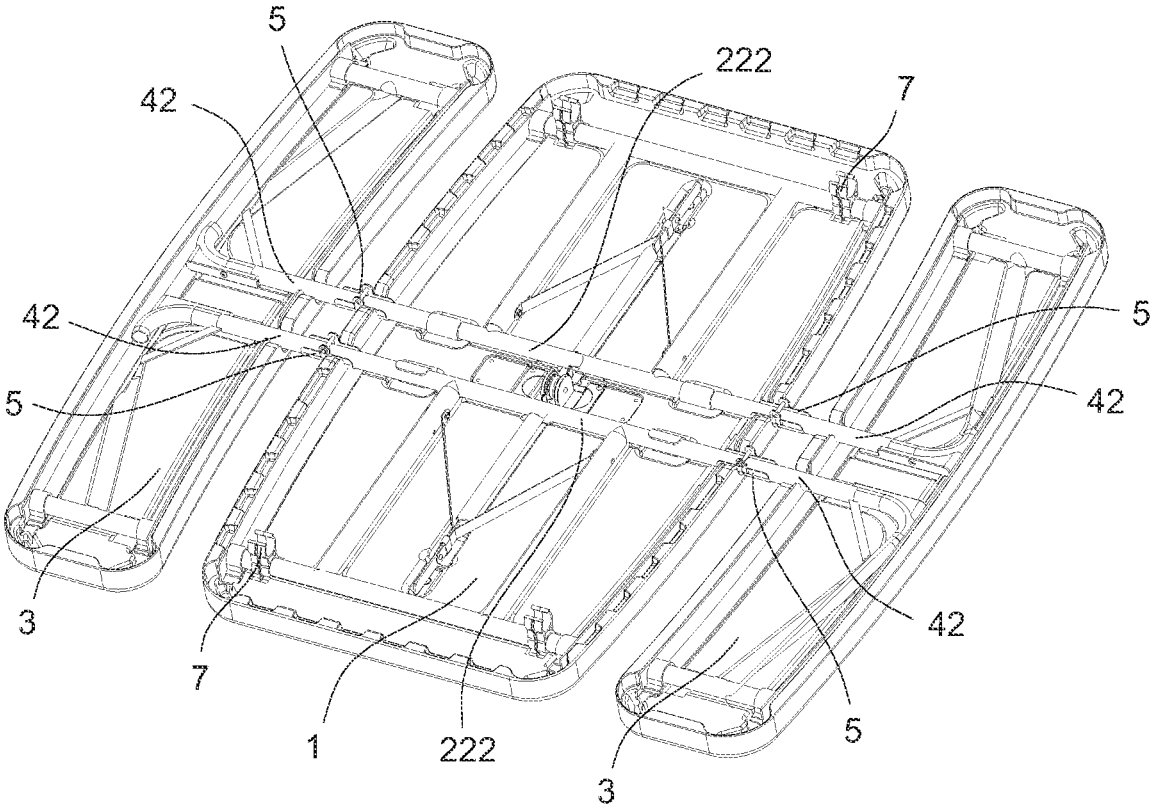
FIG. 11 is a perspective view the picnic table after the table plate and the bench bodies of the picnic table are folded to form a plane according to Embodiment 2 of the present invention.
Figure 12:
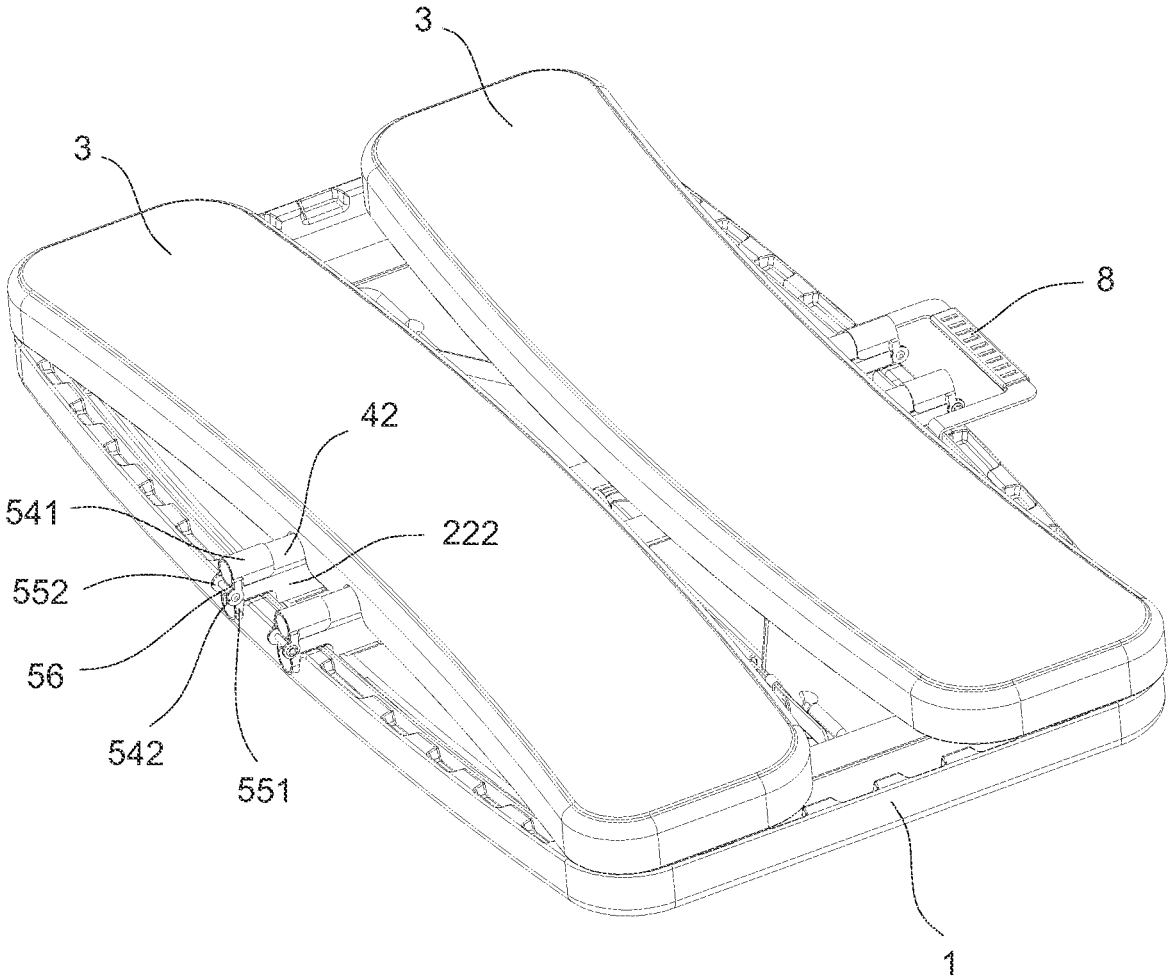
FIG. 12 is a perspective view of the picnic table after the picnic table is folded completely according to Embodiment 2 of the present invention.
Figure 13:
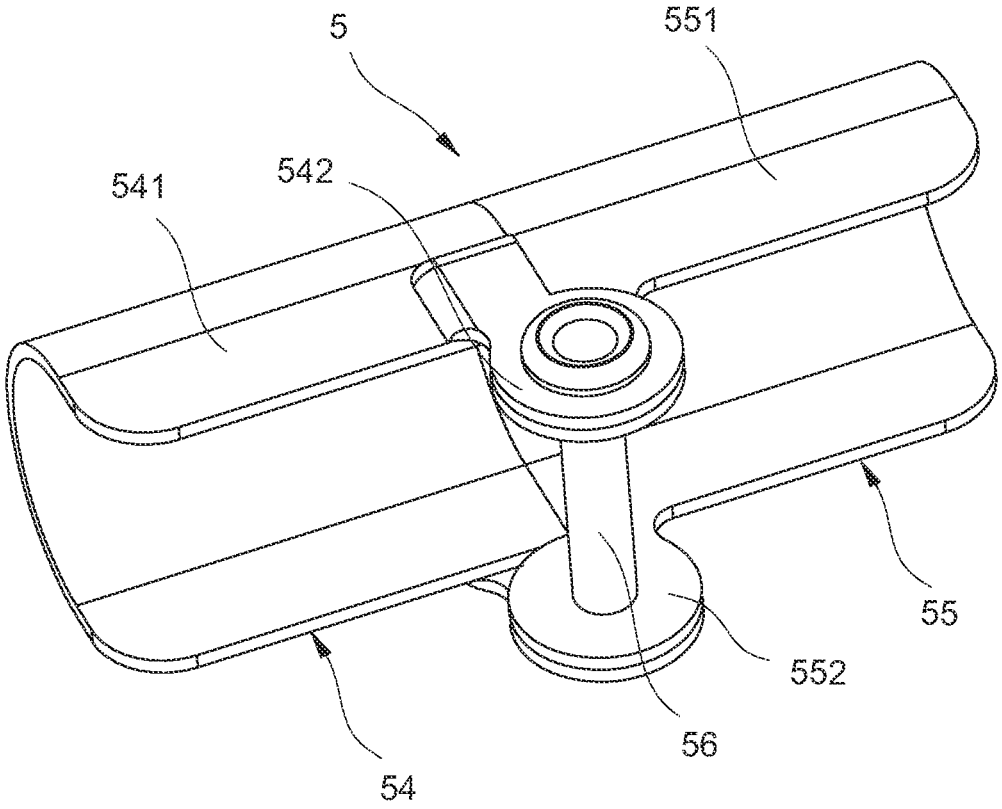
FIG. 13 is a perspective view of the connecting piece according to Embodiment 2 of the present invention.

As shown in FIGS. 11-13, each connecting piece 5 in Embodiment 2 comprises a first connector 54 and a second connector 55 both rotatable relative with each other; the first connector 54 has a U-shaped first connecting sheet 541 and a first lug 542 connected to the first connecting sheet 541; the second connector 55 has a U-shaped second connecting sheet 551 and a second lug 552 connected to the second connecting sheet 551; the first connecting sheet 541 is semi-wrapped on the corresponding horizontal rod 42, the second connecting sheet 551 is semi-wrapped on the corresponding lower transverse tube 222, a spindle 56 passes through the first lug 542 and the second lug 552, the first lug 542 and the second lug 552 are capable of rotating around the spindle 56.

When the picnic table is folded from the state shown in FIG. 12 to the state shown in FIG. 13, the first lugs 542 of the first connectors 54 and the second lugs 552 of the second connectors 55 are rotated about the spindles 56 relative to each other, and the first U-shaped connecting sheets 541 and the second U-shaped connecting sheets 551 are rotated synchronously until the first U-shaped connecting sheets 541 and the second U-shaped connecting sheets 551 are turned over to the folded state, so that the folding process is completed.

The remaining structures in Embodiment 2 are the same as those in Embodiment 1, and will not be described here.

The protection scope of the present invention is not limited to each embodiments described in this description. Any changes and replacements made on the basis of the scope of the present invention patent and of the description shall be included in the scope of the present invention patent. For example, the mechanism of the connecting piece is not limited to the above embodiments, other connecting mechanism can also be used to expand and fold each other.

The invention claimed is:

1. A foldable picnic table with sitting benches, comprising:

a table and a plurality of benches attached to the table;

the table comprises a table plate having a left side, a right side, a front side and a rear side, and a plurality of table supports rotatably connected to the left and right sides of the table plate;

each bench comprises a bench body having a left side and a right side, and a plurality of bench supports rotatably connected to the left and right sides of the bench bodies;

a plurality of connecting pieces, each connecting piece connects one bench support to one table support;

wherein, each table support has an upper support and a lower support capable of extending out of or retracting into the upper support, each upper support comprises an upper vertical tube, each lower support comprises a lower vertical tube and a lower transverse tube connected to the bottom of the lower vertical tube;

the upper vertical tubes and the lower vertical tubes are telescopic with each other and are capable of moving up and down relative to each other;

each bench support is L-shaped and has an upper rod and a horizontal rod, and each lower transverse tube is rotatably connected to the corresponding horizontal rod through the connecting pieces;

the bottom of each lower support is connected to the bottom of an adjacent bench support through a connecting piece of the plurality of connecting pieces;

the table plate is capable of being lowered to the same height as the bench bodies when the upper supports and the lower supports are retracted relative to each other, and in this state, the lower supports and the bench supports are folded to each other through the plurality of connecting pieces so as to turn over the plurality of bench bodies to the back of the table plate; and a plurality of table plate recesses for receiving the lower transverse tubes is formed on the bottom surface of the table plate, and a plurality of bench plate recesses for receiving the horizontal rods is formed on the bottom surface of each bench body.

2. The foldable picnic table of claim 1, wherein two benches are respectively disposed at the front and rear sides of the table plate.

3. The foldable picnic table of claim 2, wherein when the lower supports and the bench supports are folded toward to each other, two bench bodies of the two benches are folded over to the back of the table plate and located side by side, and the edges of the bench bodies do not extend beyond the edges of the table plate.

4. The foldable picnic table of claim 1, wherein each table support has a lock catch; and when the bench bodies and the table plate are folded to each other, each bench support is relatively fixed with the corresponding table support through the lock catch.

5. The foldable picnic table of claim 1, wherein a locking mechanism for locking the upper vertical tubes and the lower support in an extended state is disposed between one upper vertical tube and the corresponding lower vertical tube.

6. The foldable picnic table of claim 1, wherein each connecting piece comprises a first connector and a second connector both rotatable relative with each other;

the first connector has a U-shaped first connecting sheet and a first lug connected to the first connecting sheet;

the second connector has a U-shaped second connecting sheet and a second lug connected to the second connecting sheet;

the first connecting sheet is semi-wrapped on the corresponding horizontal rod, the second connecting sheet is semi-wrapped on the corresponding lower transverse tube, a spindle passes through the first lug and the second lug, the first lug and the second lug are capable of rotating around the spindle.

7. The foldable picnic table of claim 1, wherein each connecting piece comprises a first joint and a second joint both rotatable relative with each other;

the first joint has a first connecting column and a first rotating portion, the second joint has a second connecting column and a second rotating portion;

the first connecting column is inserted into the corresponding horizontal rod, the second connecting column is inserted into the corresponding lower transverse tube;

the first rotating portion is located below the second rotating portion, and a rotating shaft passes through the first rotating portion and the second rotating portion, the first rotating portion and the second rotating portion are capable of rotating around the rotating shaft.

8. The foldable picnic table of claim 7, wherein the first connecting column has a protrusion, and the second connecting column has a corresponding slot for receiving the protrusion when the first joint and the second joint are unfolded completely.

* * * * *